US007982565B2

(12) United States Patent
Bradfield et al.

(10) Patent No.: US 7,982,565 B2
(45) Date of Patent: Jul. 19, 2011

(54) INTEGRATED SOLENOID AND IGNITION MAGNETIC SWITCH

(75) Inventors: Michael D. Bradfield, Anderson, IN (US); Joel M. Gray, Fishers, IN (US); Daniel B. Teixeira, Noblesville, IN (US)

(73) Assignee: Remy Technologies, L.L.C., Pendleton, IN (US)

( * ) Notice: Subject to any disclaimer, the term of this patent is extended or adjusted under 35 U.S.C. 154(b) by 425 days.

(21) Appl. No.: 11/771,185

(22) Filed: Jun. 29, 2007

(65) Prior Publication Data

US 2009/0002105 A1 Jan. 1, 2009

(51) Int. Cl.

| | |
|---|---|
| ***H01H 9/00*** | (2006.01) |
| ***H01H 67/02*** | (2006.01) |
| ***H01H 3/00*** | (2006.01) |
| ***H01F 7/08*** | (2006.01) |

(52) U.S. Cl. ..... 335/184; 335/126; 335/131; 335/177; 335/187; 335/189; 335/191; 335/220

(58) Field of Classification Search ..... 335/126, 335/131, 177, 184, 187, 189, 191, 220, 255, 335/266, 278

See application file for complete search history.

(56) References Cited

U.S. PATENT DOCUMENTS

| | | | | |
|---|---|---|---|---|
| 1,918,798 | A * | 7/1933 | Churcher | 335/136 |
| 2,086,197 | A * | 7/1937 | Warner | 335/162 |
| 5,563,563 | A * | 10/1996 | Freitas et al. | 335/126 |
| 5,677,656 | A * | 10/1997 | Mauch et al. | 335/126 |
| 5,892,422 | A * | 4/1999 | Montaigu et al. | 335/126 |
| 6,380,831 | B1 * | 4/2002 | Kajino | 335/127 |
| 6,937,122 | B2 * | 8/2005 | Ho et al. | 335/126 |
| 2004/0012902 | A1 * | 1/2004 | Ikeda | 361/23 |

* cited by examiner

*Primary Examiner* — Anh T Mai
*Assistant Examiner* — Mohamad A Musleh
(74) *Attorney, Agent, or Firm* — Cantor Colburn LLP

(57) ABSTRACT

A solenoid includes a solenoid housing defining a solenoid centerline; and an ignition magnetic switch including an ignition magnetic switch coil disposed at least partially within the housing, the ignition magnetic switch coil having a magnetic field that encompasses the solenoid centerline.

14 Claims, 5 Drawing Sheets

INTEGRATED SOLENOID AND IGNITION MAGNETIC SWITCH

BACKGROUND OF THE INVENTION

This disclosure relates generally to solenoids of the type utilized in vehicle starter motors. More specifically, this disclosure relates to solenoids including an integrated ignition magnetic switch.

Vehicle starter motors are typically provided with a drive assembly and a solenoid, with a shift lever connecting the solenoid to the drive assembly. When a solenoid coil is energized, a solenoid plunger extends, thereby actuating the shift lever and engaging a starter pinion gear with a flywheel of the engine. Vehicle starter motors that utilize a soft-start engagement system must provide a substantial amount of current prior to actual crank to begin rotation of the starter pinion gear and to cause the pinion gear to engage with the flywheel. The current needed typically ranges from 200 A to 400 A depending on the particular starter motor and engine. This amount of current is much greater than the 4-6 A that common ignition switches are capable of reliably handling. Therefore a separate ignition magnetic switch (IMS) is utilized, limiting current draw of the starter motor upon activation of the IMS to current in the rage of 2-4 A. When the IMS is activated, a pull-in coil in the solenoid is connected to a vehicle battery. Current then flows to the starter motor allowing the pinion gear to rotate and engage the flywheel. The IMS is a separate component from the solenoid and starter motor and is located external to these components.

SUMMARY OF THE INVENTION

A solenoid includes a solenoid housing defining a solenoid centerline; and an ignition magnetic switch including an ignition magnetic switch coil disposed at least partially within the housing, the ignition magnetic switch coil having a magnetic field that encompasses the solenoid centerline.

A solenoid includes a solenoid plunger and a solenoid centerline; and an ignition magnetic switch including: an ignition magnetic switch plunger; and an ignition magnetic switch coil that encompasses both the ignition magnetic switch plunger and the solenoid centerline.

Further, a solenoid is disclosed that includes at least two differently actuating coils.

DESCRIPTION OF THE DRAWINGS

The above, as well as other advantages of the present invention, will become readily apparent to those skilled in the art from the following detailed description when considered in light of the accompanying drawings in which.

DETAILED DESCRIPTION OF THE INVENTION

Figure 1:
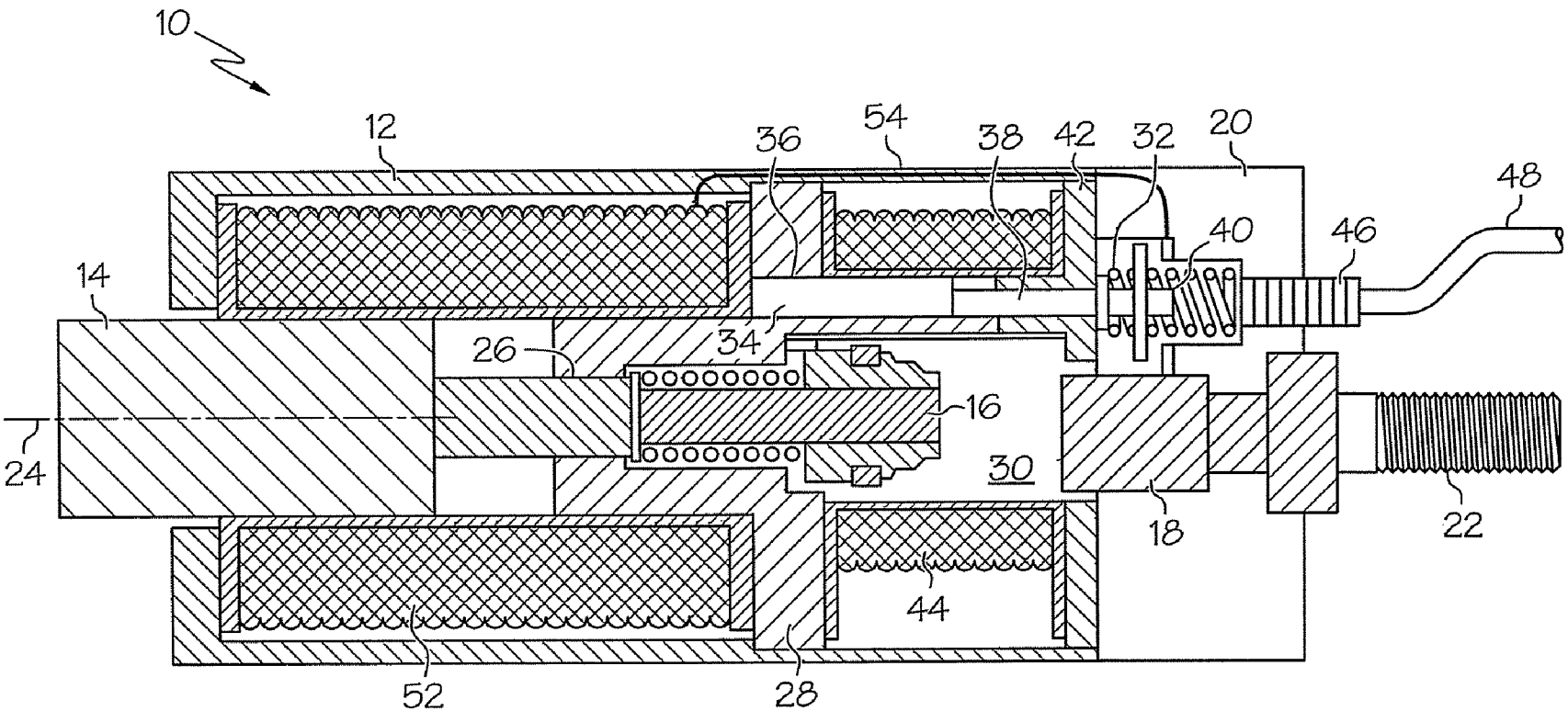
FIG. 1 is a cross-sectional view of an embodiment of a solenoid with integral IMS.

Shown in FIG. 1 is an embodiment of a solenoid 10 in accordance with the teaching herein. The solenoid 10 includes a housing 12 having a centerline 24. The solenoid housing 12 contains at least one solenoid plunger 14 having a solenoid plunger contact 16. Each solenoid plunger contact 16 is substantially aligned with a battery terminal contact 18 and/or a motor terminal contact (not shown). Each contact is, in one embodiment, disposed in a solenoid cap 20 of the solenoid housing 12. Battery terminal contact 18 corresponds to a battery terminal 22. The solenoid plunger 14 is disposed axially in the housing 12 substantially along solenoid centerline 24. The solenoid plunger contact 16, further extending along the centerline is sufficiently long to reach the terminal contact 18 when the solenoid plunger contact 16 is urged through a plunger hole 26 in a guide plate 28 by the plunger 14. As the solenoid plunger contact 16 extends toward the terminal contact 18, the solenoid plunger contact 16 advances through a volume 30.

An integral ignition magnetic switch (IMS) 32 is, in one configuration, disposed at least partially inside the housing 12 and is disposed longitudinally to avoid encroaching into the volume 30 swept by the solenoid plunger contact 16 when it extends toward the terminal contact 18. The integral IMS 32 includes an IMS stopper 34 fixed to the guide plate 28. In this embodiment, the IMS stopper 34 is fixed by insertion into a stopper hole 36 in the guide plate 28, but it is to be appreciated that the IMS stopper 34 may be fixed in other ways within the scope of the teaching hereof. An IMS plunger 38 and an IMS terminal 40 are disposed in the solenoid cap 20 such that the IMS plunger 38 is of sufficient length to reach the IMS stopper 34 when the IMS plunger 38 is extended from the IMS terminal 40 through a contact plate 42. In some embodiments, the IMS plunger 38 is disposed and configured substantially parallel to the solenoid plunger 14. The IMS plunger 38 substantially aligns with the IMS stopper 34 to ensuring the IMS plunger 38 contacts the IMS stopper 34 when the integral IMS 32 is activated.

Figure 2:
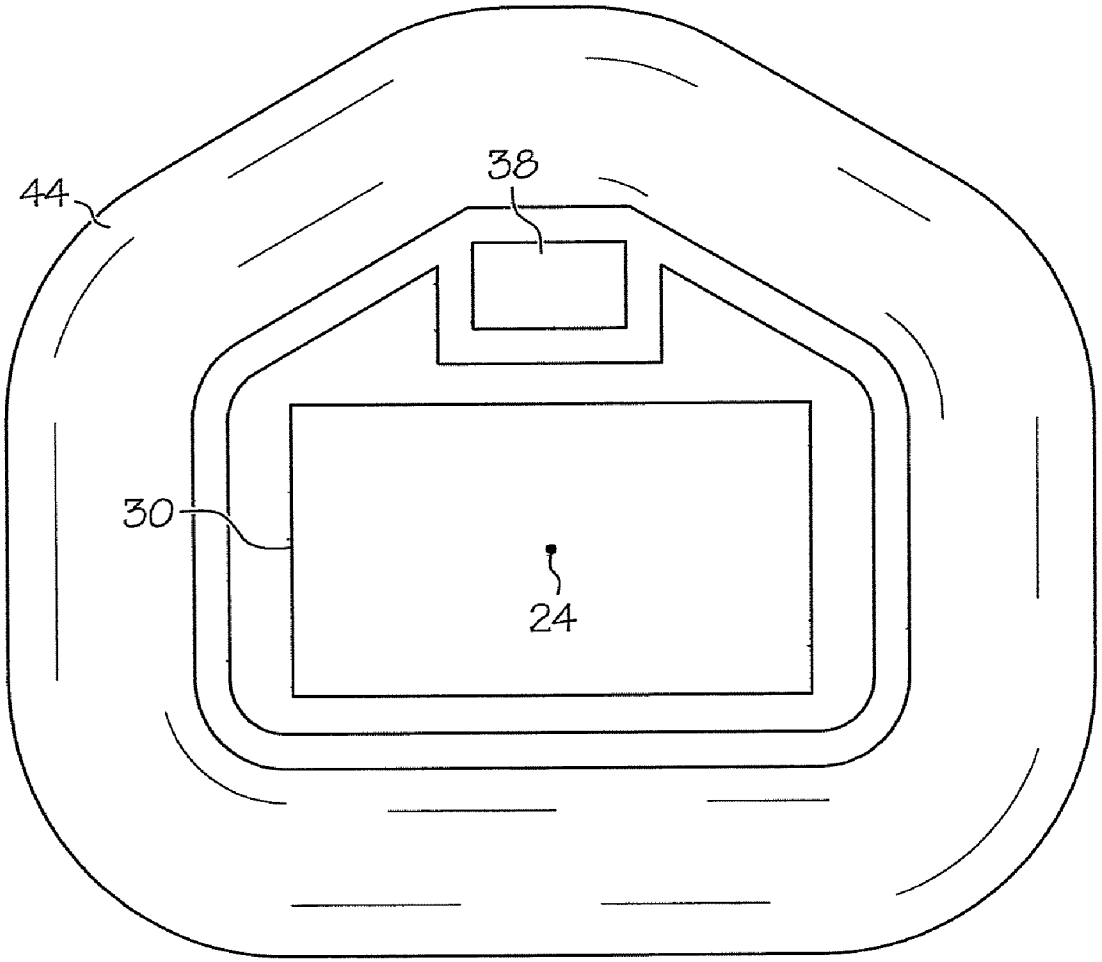
FIG. 2 is a cross-sectional view of an embodiment of an IMS coil.
Figure 3:
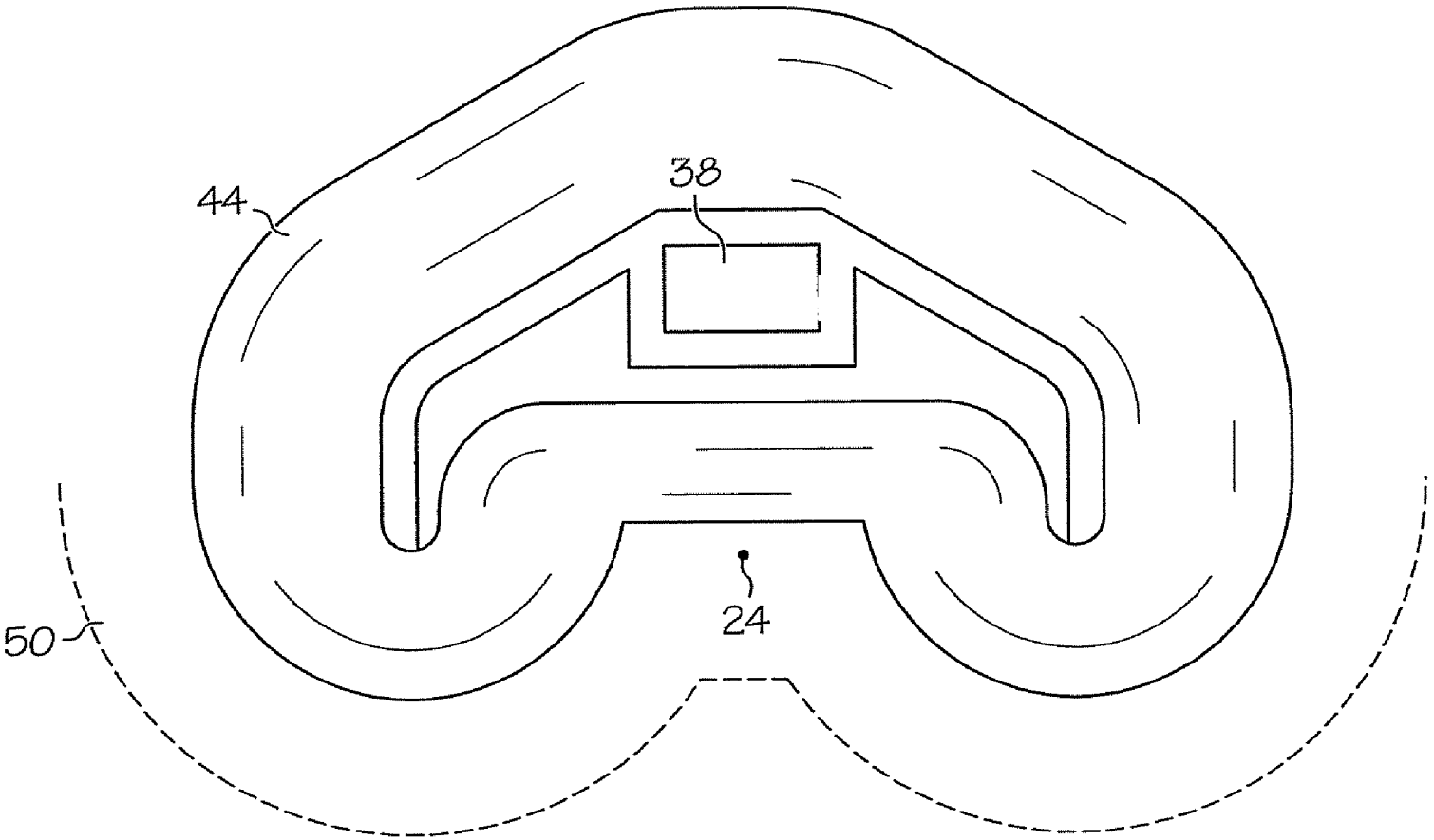
FIG. 3 is a cross-sectional view of an alternative embodiment of an IMS coil.

The IMS 32 further includes a coil 44 disposed at least partially within the solenoid housing 12. The IMS coil 44 is electrically connected to an S-terminal 46, which is, in turn, connected to a vehicle ignition switch (not shown) via an ignition switch wire 48. The IMS coil 44 is, in the embodiment shown in FIG. 1, disposed and configured in the housing 12 such that a magnetic field thereof, when energized, substantially encompasses the solenoid centerline 24. By so configuring the IMS coil 44, sufficient force is maintained for IMS plunger 38 to activate the solenoid 10 even while the solenoid configuration hereof deletes the conventional round iron core of prior art IMS devices. Additionally, the EMS coil configuration having a magnetic field that substantially encompasses the solenoid centerline effectively reduces required current levels in the arrangements disclosed herein to contemporary industry requirements. These requirements as will be recognized by one of ordinary skill in the art have been significantly reduced from conventional levels due to manufacturing considerations. In the stated configuration, it is the length of IMS coil 44 windings achieved by the geometric configuration of windings (which maximizes the size of the coil) hereof that causes both the solenoid centerline 24 to be magnetically encompassed and the current levels to be reduced, for example to contemporary industry requirements of 3.5 to 4 amps. As shown in FIG. 1, the IMS coil 44 is wrapped substantially perimetrically around the solenoid plunger 14 (which also happens to be along the centerline 24), avoiding volume 30 swept by the solenoid plunger contact 16. In some embodiments, the coil only magnetically encompasses the centerline and physically does not while in other embodiments the coil will both magnetically and physically encompass or even surround the centerline 24. As used herein, the term "encompass" is intended to be more broadly construed than "surround" such that "encompass" will include the coil physically or magnetically intersecting the centerline or "surrounding" the centerline while "surrounds" indicates more narrowly that the centerline is within an inside dimension of the coil, for example. As shown in FIG. 2, the IMS coil 44 is substantially pentagonally shaped and physically as well as magnetically encompasses the IMS plunger 38 and volume 30 as described above. In other embodiments, such as shown in FIG. 3, the IMS coil 44 may be substantially U-shaped or horseshoe-shaped. The IMS coil 44 of FIG. 3 encompasses the IMS plunger 38 physically, while a magnetic field 50 of the IMS coil 44 encompasses the solenoid centerline 24. It is to be appreciated, however, that the cross sectional configurations of the IMS coil 44 shown here are exemplary, and other cross-sectional configurations of IMS coils 44 are contemplated.

Figure 4:
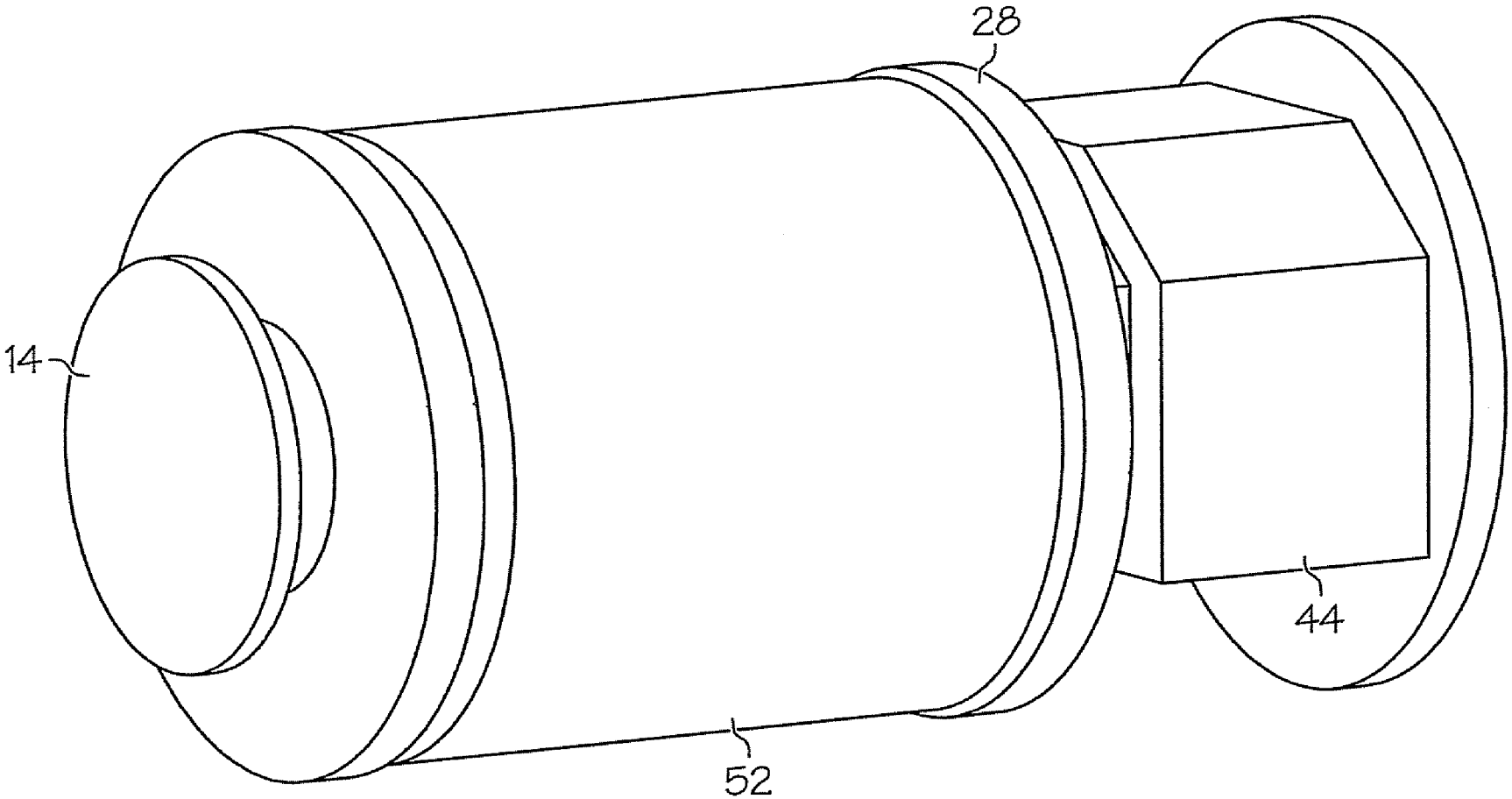
FIG. 4 is a perspective view illustrating coil installation for the solenoid of FIG. 1.

Referring again to FIG. 1, a solenoid coil 52 is disposed in the housing 12, and is wrapped circumferentially around the one or more solenoid plungers 14. The solenoid coil 52 is electrically connected to the integral IMS 32 by, for example, a solenoid wire 54, which in some embodiments is disposed entirely within the solenoid housing 12. An additional view of the coils 44, 52 as installed is shown in FIG. 4. Referring again to FIG. 1, when the vehicle ignition switch is activated, current flows into the IMS coil 44 from the battery terminal 22. The current flow through the IMS coil 44 creates the magnetic field 50, causing the IMS plunger 38 to extend to and contact the IMS stopper 34, thus allowing current to flow from the battery terminal 22 to the solenoid coil 52. As will thus be appreciated, the solenoid disclosed includes at least two differently actuating coils. One coil actuates the solenoid plunger and one coil actuates the IMS plunger, both coils being located at least partially within the solenoid housing. In some embodiments, the IMS coil 44 and the solenoid coil 52 share at least one magnetic path. In one embodiment, the magnetic path shared by the IMS coil 44 and the solenoid coil 52 is the guide plate 28.

Figure 5:
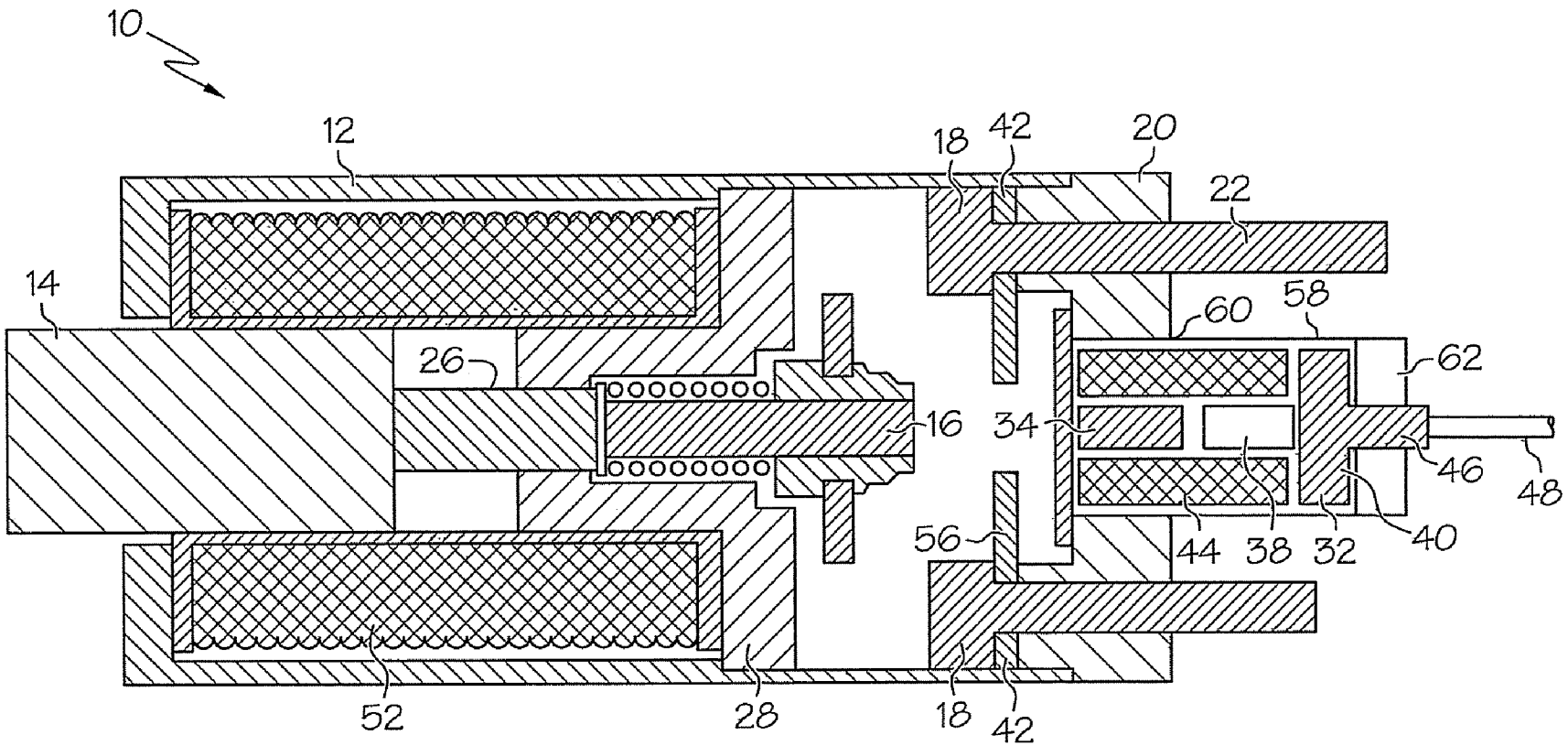
FIG. 5 is a cross-sectional view of another embodiment of a solenoid with integral IMS.

Another embodiment of a solenoid 10 with an integral IMS 32 is shown in FIG. 5. In this embodiment, the integral IMS 32 is fixed to the cap 20 by an affixment arrangement such as mechanical fasteners, adhesive, welding, or other means and is disposed entirely on a cap side 56 of the contact plate 42 in a radial location between the terminal contacts 18. In some embodiments, the integral IMS 32 may extend through the cap 20 to an exterior of the cap 20 via an IMS hole 60. The portion of the integral IMS 32 extending through the cap 20 is enclosed in an IMS case 58. In this embodiment, the IMS case 58 may contain the IMS stopper 34, the IMS plunger 38, IMS terminal 40, and/or IMS coil 44. An IMS cover 62 encloses the integral IMS 32 within the IMS case 58. As shown, the S-terminal 46 extends through the IMS cover 62 for connection to the ignition switch wire 48. Alternatively, the cap 20 may be formed to accommodate the entire integral IMS 32. Utilizing an integral IMS 32 with the solenoid 10 minimizes an amount of wiring utilized and frees space normally occupied by an IMS to be utilized for other purposes.

While embodiments of the invention have been described above, it will be understood that those skilled in the art, both now and in the future, may make various improvements and enhancements which fall within the scope of the claims which follow. These claims should be construed to maintain the proper protection for the invention first described.

What is claimed is:

1. A solenoid comprising:

a solenoid housing defining a solenoid centerline a solenoid plunger disposed at least partially within the solenoid housing; and an ignition magnetic switch including:

an ignition magnetic switch coil disposed at least partially within the housing, the ignition magnetic switch coil having a magnetic field that encompasses the solenoid centerline; and an ignition magnetic switch plunger disposed non-coaxially with the solenoid plunger and having a direction of travel substantially parallel to the solenoid centerline.

2. The solenoid of claim 1 wherein the ignition magnetic switch coil physically encompasses the solenoid centerline.

3. The solenoid of claim 1 wherein the ignition magnetic switch coil physically surrounds the solenoid centerline.

4. The solenoid of claim 1 wherein the ignition magnetic switch coil intersects the solenoid centerline.

5. The solenoid of claim 1 wherein the ignition magnetic switch coil is of an angular geometric shape.

6. The solenoid of claim 5 wherein the angular geometric shape is pentagonal.

7. The solenoid of claim 1 wherein the solenoid plunger is disposed within the magnetic field of the ignition magnetic switch coil.

8. The solenoid of claim 1 wherein the solenoid plunger is disposed within the ignition magnetic switch coil.

9. The solenoid of claim 1 wherein the ignition magnetic switch is entirely disposed within the housing.

10. The solenoid of claim 1 further comprising a solenoid coil.

11. The solenoid of claim 10 wherein the ignition magnetic switch coil and the solenoid coil are each electrically connected to a shared battery terminal.

12. The solenoid of claim 10 wherein the ignition magnetic switch coil and the solenoid coil share at least one magnetic path.

13. The solenoid of claim 1 wherein the ignition magnetic switch coil is configured for a current flow through the ignition magnetic switch coil of 3.5-4 amps.

14. The solenoid of claim 1 wherein the solenoid is in operable communication with a vehicle starter motor.

* * * * *